US011783766B1

(12) United States Patent
Li et al.

(10) Patent No.: US 11,783,766 B1
(45) Date of Patent: Oct. 10, 2023

(54) PIXEL DRIVE CIRCUIT, DRIVING METHOD, AND DISPLAY PANEL

(71) Applicant: HKC CORPORATION LIMITED, Shenzhen (CN)

(72) Inventors: Zeyao Li, Shenzhen (CN); Baohong Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/206,098

(22) Filed: Jun. 6, 2023

(30) Foreign Application Priority Data

Dec. 19, 2022 (CN) ..... 202211633060.8

(51) Int. Cl.
*G09G 3/32* (2016.01)

(52) U.S. Cl.
CPC ..... *G09G 3/32* (2013.01); *G09G 2310/0297* (2013.01); *G09G 2320/0633* (2013.01); *G09G 2330/021* (2013.01)

(58) Field of Classification Search
CPC ..... G09G 3/32; G09G 2310/0297; G09G 2320/0633; G09G 2330/021
See application file for complete search history.

(56) References Cited

U.S. PATENT DOCUMENTS

2021/0065616 A1* 3/2021 Kim ..... G09G 3/3233
2022/0101783 A1* 3/2022 Han ..... G09G 3/32
2022/0198995 A1* 6/2022 Ahmed ..... H01L 27/1255

FOREIGN PATENT DOCUMENTS

CN 108694908 A 10/2018
CN 217880811 U 11/2022

OTHER PUBLICATIONS

Chinese First Office Action, Chinese Application No. 202211633060.8, dated Jan. 29, 2023 (15 pages).

* cited by examiner

*Primary Examiner* — Andrew Sasinowski

(57) ABSTRACT

Disclosed are a pixel drive circuit, a driving method, and a display panel. The pixel drive circuit includes a light-emitting element, a power supply line, and a pulse amplitude modulation unit and a pulse width modulation unit connected between a high-potential power supply of the power supply line and an anode of the light emitting element. The pulse amplitude modulation unit provides driving currents with different amplitudes to the light emitting element. The pulse width modulation unit includes a second drive transistor, a first transistor and a second transistor, and a pulse width modulation circuit. The pulse width modulation circuit generates a corresponding drive signal to control the first transistor or the second transistor to be turned on based on the first data voltages during a luminescence phase, and controls the second drive transistor to be turned on to control the duration of the driving currents of the light-emitting element.

19 Claims, 9 Drawing Sheets

| PAM Level | Vdata_3 |
|---|---|
| 0 | X1 |
| ..... | ..... |
| 3 | X3 |
| ..... | ..... |
| 7 | X7 |
| ..... | ..... |
| 11 | X11 |
| ..... | ..... |
| n | Xn |

+

| PWM Level | Vdata_1 |
|---|---|
| 0 | Y1 |
| ..... | ..... |
| 3 | Y3 |
| ..... | ..... |
| 7 | Y7 |
| ..... | ..... |
| 11 | Y11 |
| ..... | ..... |
| m | Ym |

=

| Gray LEVEL | PWM Level | PWM Level |
|---|---|---|
| 0 | 0 | 0 |
| ..... | ..... | ..... |
| 63 | xi | yi |
| ..... | ..... | ..... |
| 127 | xi | yi |
| ..... | ..... | ..... |
| 191 | xi | yi |
| ..... | ..... | ..... |
| 255 | xi | yi |

FIG. 4

| PAM Level | Vdata_3 |
|---|---|
| 0 | X1 |
| ..... | ..... |
| 3 | X3 |
| ..... | ..... |
| 7 | X7 |
| ..... | ..... |
| 11 | X11 |
| ..... | ..... |
| n | Xn |

+

| PWM Level | Vdata_1 |
|---|---|
| 0 | Y1 |
| 1 | Y2 |
| 2 | Y3 |

=

| Gray LEVEL | PWM Level | PWM Level |
|---|---|---|
| 0 | 0 | 0 |
| ..... | ..... | ..... |
| 63 | x1 | y1 |
| ..... | ..... | ..... |
| 127 | x2 | y2 |
| ..... | ..... | ..... |
| 191 | x3 | y3 |
| ..... | ..... | ..... |
| 255 | x4 | y4 |

FIG. 5

PIXEL DRIVE CIRCUIT, DRIVING METHOD, AND DISPLAY PANEL

CROSS REFERENCE

The present application claims priority of China Patent Application No. 202211633060.8 filed on Dec. 19, 2022, the entire contents of which are hereby incorporated by reference.

TECHNICAL FIELD

The present disclosure relates to the field of display panels, and in particular to a pixel drive circuit, a driving method, and a display panel.

BACKGROUND

Currently, inorganic micro light emitting diode (Micro LED) displays are one of the hot spots in display research.

Compared with OLED displays, Micro LEDs have the advantages of high reliability, low power consumption, high brightness, and fast response time, etc. Among them, the drive circuit for controlling the LED light emission is the core technology of Micro LED display and has important research significance.

However, since the luminous efficiency of LEDs varies greatly under different driving currents, in order to reduce the power consumption of Micro LED displays, it is necessary to maintain the LEDs working at relatively high currents for keeping the LEDs always in a high-efficiency operating range, thereby achieving gray-scale cutting.

SUMMARY OF THE DISCLOSURE

The main technical problem solved by the present disclosure is to provide a pixel drive circuit and its driving method, and a display panel to realize the light-emitting element to maintain in a high-efficiency working range, thereby achieving gray-scale cutting.

To solve the above technical problem, the present disclosure provides a pixel drive circuit, including: a power supply line, comprising a high-potential power supply and a low-potential power supply; a light-emitting element; connected between the high-potential power supply and the low-potential power supply; a pulse amplitude modulation unit, comprising: a first drive transistor connected to an anode of the light-emitting element and the high-potential power supply, and a pulse amplitude modulation circuit connected to a control end of the first drive transistor; wherein the first drive transistor is configured to provide driving currents with different amplitudes to the light-emitting element according to a voltage applied at the control end by the pulse amplitude modulation circuit; and a pulse width modulation unit, comprising: a second drive transistor, connected to the anode of the light-emitting element and the pulse amplitude modulation unit; a first transistor and a second transistor, connected to a control end of the second drive transistor; a pulse width modulation circuit, connected to a control end of the first transistor and a control end of the second transistor; wherein a first end of the first transistor is connected to the high-potential power supply, a second end of the first transistor is connected to a first end of the second transistor, and the control end of the first transistor is connected to the pulse width modulation circuit; a second end of the second transistor is connected to the low-potential power supply, and the control end of the second transistor is connected to the pulse width modulation circuit; a third transistor; wherein a first end of the third transistor is connected to a first data line to receive first data voltages of different voltage levels output from the first data line, and a second end of the third transistor is connected to a first node; a fourth transistor; wherein a first end of the fourth transistor is connected to a second data line to receive a second data voltage output from the second data line, a second end of the fourth transistor is connected to a control end of the third transistor, and a control end of the fourth transistor is connected to a first scan control line; and a first capacitor; wherein a first pole plate of the first capacitor is connected to the low-potential power supply, and a second pole plate of the first capacitor is connected to the control end of the third transistor; wherein the second drive transistor is of a same type as the first transistor, one of the first transistor and the second transistor being a P-type transistor, and the other of the first transistor and the second transistor being an N-type transistor; the pulse width modulation circuit is configured to output the first data voltages of different voltage levels with the first data line during a luminescence phase, for generating corresponding drive signals to control the first transistor or second transistor to be turned on, and controlling the second drive transistor to be turned on to control a duration of the driving currents of the light-emitting element.

In some embodiments, the pulse width modulation unit further comprises a reset transistor; a first end of the reset transistor is connected to the first node, a second end of the reset transistor is connected to the low-potential power supply, and a control end of the reset transistor is connected to a reset control line; wherein the first node is a point where the pulse width modulation circuit is connected to the control end of the first transistor and the control end of the second transistor.

In some embodiments, the third transistor is a P-type transistor; for one of the first data voltages of different voltage levels, in response to a voltage sum of the first data voltage of a voltage level output and a threshold voltage of third transistor being less than the second data voltage, the third transistor is turned off; in response to the voltage sum of the first data voltage of the voltage level and the threshold voltage of the third transistor being greater than the second data voltage, the third transistor is turned on; wherein a turned-on time of the second drive transistor is associated with a magnitude of the second data voltage and a magnitude of the first data voltages of different levels.

In some embodiments, the pulse width modulation circuit further comprises a second capacitor; a first pole plate of the second capacitor is connected to the high-potential power supply, and a second pole plate of the second capacitor is connected to the first node.

In some embodiments, the pulse amplitude modulation circuit comprises a fifth transistor and a third capacitor; a first end of the fifth transistor is connected to a third data line, a second end of the fifth transistor is connected to the control end of the first drive transistor, and a control end of the fifth transistor is connected to a second scan control line; a first pole plate of the third capacitor is connected to the high-potential power supply, and a second pole plate of the third capacitor is connected to the control end of the first drive transistor.

In some embodiments, the pulse amplitude modulation circuit comprises a fifth transistor; a first end of the fifth transistor is connected to a third data line, a second end of the fifth transistor is connected to the control end of the first drive transistor, and a control end of the fifth transistor is connected to a second scan control line; wherein the first data line, the second data line, and the third data line are multiplexed.

To solve the above technical problem, the present disclosure further provides a driving method of a pixel drive circuit, applied to the pixel drive circuit in any of the above embodiment and including: during a reset phase, outputting, by a reset control line of an Nth row, a reset signal to control a reset transistor to be turned on, and outputting, by a low-potential power supply, a low-potential voltage to a control end of a first transistor through the reset transistor, for causing the first transistor to be turned on; during a data writing phase, outputting, by a first scan control line of an Nth row, a first scan signal to control a fourth transistor to be turned on, and outputting, by a second data line, a second data voltage to a control end of a third transistor through the fourth transistor; outputting, by a second scan control line of an Nth row, a second scan signal to control a fifth transistor to be turned on, and outputting, by a third data line, a third data voltage to a control end of a first drive transistor through the fifth transistor; and during a luminescence phase, outputting, by a first data line, first data voltages of different voltage levels to the control end of the first transistor and a control end of a second transistor, selectively, through the third transistor, for controlling the first transistor or the second transistor to be turned on, and further controlling the second drive transistor to be turned on to control a duration of a driving current of a light-emitting element.

In some embodiments, a turned-on time of the second drive transistor is associated with a magnitude of the second data voltage and a magnitude of the first data voltages of different levels.

To solve the above technical problem, the present disclosure further provides a display panel, including a plurality of pixel cells arranged in an array; wherein each pixel cell is arranged with the pixel drive circuit in any of the above embodiments.

The beneficial effect of the present disclosure is that, in contrast to the related art, the driving currents of the light-emitting element are modulated by controlling the voltage at the control end of the first drive transistor of the pulse amplitude modulation unit. The pulse width modulation unit includes a second drive transistor connected in series to the anode of the light-emitting element and the pulse amplitude modulation unit; a first transistor and a second transistor connected to the control end of the second drive transistor; and a pulse width modulation circuit, connected to the control end of the first transistor and the control end of the second transistor; wherein a first end of the first transistor is connected to the high-potential power supply, a second end of the first transistor is connected to a first end of the second transistor, and the control end of the first transistor is connected to the pulse width modulation circuit; a second end of the second transistor is connected to the low-potential power supply, and the control end of the second transistor is connected to the pulse width modulation circuit; the second drive transistor is of a same type as the first transistor, one of the first transistor and the second transistor being a P-type transistor, and the other of the first transistor and the second transistor being an N-type transistor; the pulse width modulation circuit is connected to a first data line to output the first data voltages of different voltage levels with the first data line during a luminescence phase, for generating corresponding drive signals to control the first transistor or second transistor to be turned on, and controlling the second drive transistor to be turned on to control a duration of the driving currents of the light-emitting element. In this way, the light-emitting element may maintain in a high-efficiency working range, thereby achieving gray-scale cutting.

BRIEF DESCRIPTION OF THE DRAWINGS

In order to more clearly illustrate the technical solutions in the embodiments of the present disclosure, the following will briefly describe the accompanying drawings required in the description of the embodiments, it is obvious that the following description of the accompanying drawings are only some of the embodiments of the present disclosure. For those skilled in the art, other accompanying drawings may be obtained from these drawings without creative labor.

FIG. 4 is a correspondence schematic view between a first data voltage, a third data voltage, and a gray scale according to an embodiment of the present disclosure.

FIG. 5 is a correspondence schematic view between a first data voltage, a third data voltage, and a gray scale according to another embodiment of the present disclosure.

NUMERAL REFERENCE

Figure 1:
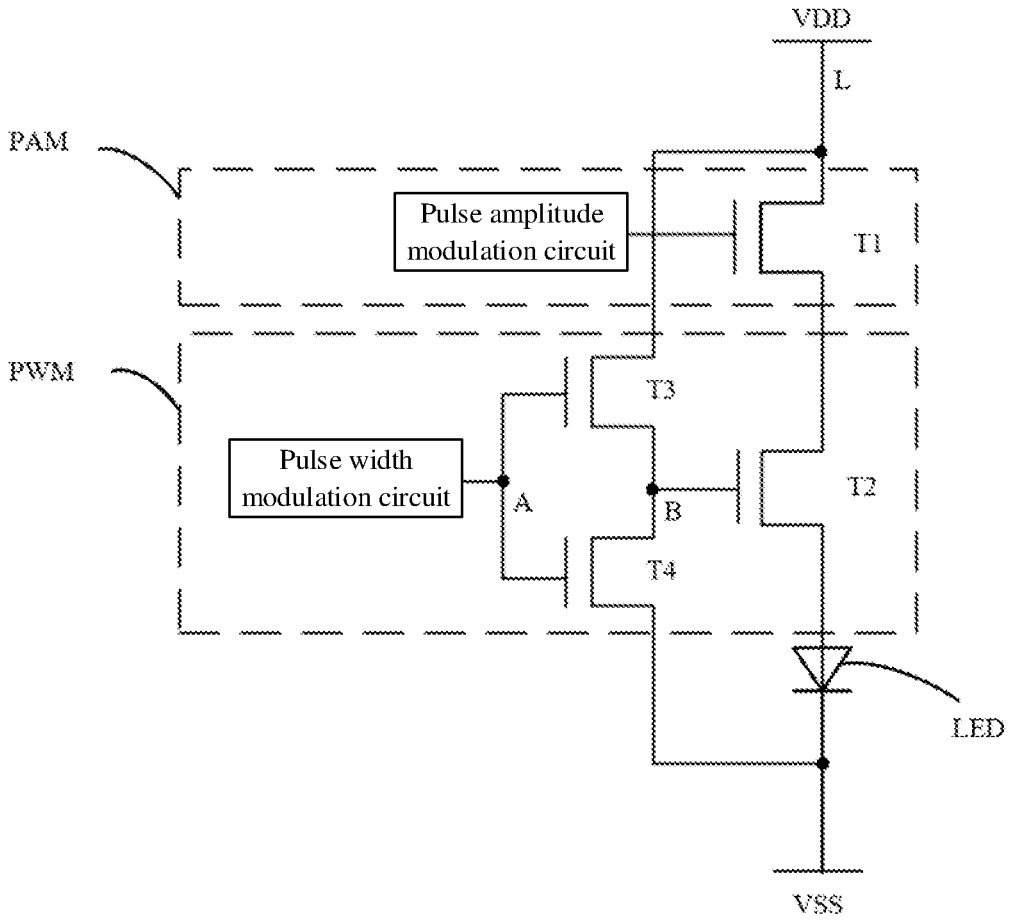
FIG. 1 is a structural block view of a pixel drive circuit according to an embodiment of the present disclosure.

LED, light-emitting element;

L, power supply line; VDD, high-potential power supply line; VSS, low-potential power supply line;

PAM, pulse amplitude modulation unit; T8, fifth transistor; C1, third capacitor;

PWM, pulse width modulation unit; T1, first drive transistor; T2, second drive transistor; T3, first transistor; T4, second transistor; T5, reset transistor; T6, third transistor; T7, fourth transistor; C1, first capacitor; C2, second capacitor;

L_Reset, reset control line; Reset, reset signal; L1, first data line; Vdata_1, first data voltage; L2, second data line; Vdata_2, second data voltage; L3, third data line; Vdata_3, third data voltage; L_Scan1, first scan control line; PWM_Scan, first scan signal; L_Scan2, second scan control line; PAM_Scan, second scan signal; Vth, threshold voltage; A, first node; B, second node; C, third node; 110, pixel unit.

DETAILED DESCRIPTION

The following will be a clear and complete description of the technical solutions in the embodiments of the present disclosure, in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without making creative labor fall within the scope of the present disclosure.

The terms used in the embodiments of the present disclosure are intended solely for the purpose of describing particular embodiments and are not intended to limit the present disclosure. The singular forms of "one", "said", and "the" as used in the embodiments of the present disclosure and the appended claims are also intended to include plural forms, unless clearly indicated above. Unless other meanings are clearly indicated above, "a plurality" generally includes at least two, but does not exclude the inclusion of at least one.

It should be understood that the term "and/or" as used herein is simply a description of the association of related objects, indicating that three relationships can exist, e.g., A and/or B, which can mean: A alone, both A and B, and B alone. In addition, the character "/" in this document generally indicates that the associated objects before and after are in an "or" relationship. The terms "first", "second", etc. in the specification, claims, and the above-mentioned drawings of the present disclosure are used to distinguish similar objects, and need not be used to describe a specific order or sequence.

It is to be understood that the term "including", "comprising", or any other variation thereof, as used herein, is intended to cover non-exclusive inclusion such that a process, method, article, or apparatus including a series of elements includes not only those elements, but may further include other elements not expressly listed, and may further include elements that are inherent to such process, method, article, or apparatus. Without further limitation, the elements defined by the statement "including . . . " do not preclude the existence of additional identical elements in the process, method, article, or apparatus that include said elements.

It should be noted that when there are directional indications (such as up, down, left, right, forward, backward . . . ) in the present disclosure, the directional indications are intended only to explain the relative positions, movements, etc. of components in a particular posture (as shown in the accompanying drawings), and if that particular posture is changed, the directional indications are also changed accordingly.

References herein to "embodiments" mean that particular features, structures, or characteristics described in connection with the embodiments may be included in at least one embodiment of the present disclosure. The presence of the phrase at each location in the specification does not necessarily mean the same embodiment, nor is it a separate or alternative embodiment that is mutually exclusive with other embodiments. It is understood, both explicitly and implicitly, by those skilled in the art that the embodiments described herein may be combined with other embodiments.

The present disclosure provides a pixel drive circuit. Referring to FIG. 1, FIG. 1 is a structural block view of a pixel drive circuit according to an embodiment of the present disclosure. As illustrated in FIG. 1, the pixel drive circuit includes: a light-emitting element LED, a power supply line L, a pulse amplitude modulation unit PAM, and a pulse width modulation unit PWM.

The light-emitting element LED is a light-emitting diode or an organic light-emitting diode.

The power supply line L includes a high-potential power supply VDD and a low-potential power supply VSS. The high-potential power supply VDD is configured to output a high-potential voltage, and the low-potential power supply VSS is configured to output a low-potential voltage. The light-emitting element LED is connected in series between the high-potential power supply VDD and the low-potential power supply VSS, and the light-emitting element LED is turned on and emits light when there is a voltage difference between two ends of the light-emitting element LED. The low-potential power supply VSS may be grounded, without specific limitation herein.

In the embodiments, the high-potential power supply VDD in the power supply line L is connected in series with the pulse amplitude modulation unit PAM, the pulse width modulation unit PWM, the light-emitting element LED, and the low-potential power supply VSS in sequence. In other words, the current flows from the high-potential power supply VDD through the pulse amplitude modulation unit PAM, the pulse width modulation unit PWM, and the anode of the light-emitting element LED, and then flows from the cathode of the light-emitting element LED to the low-potential power supply VSS.

Of course, in other embodiments, the pulse amplitude modulation unit PAM and pulse width modulation unit PWM order may be switched, without specific limitation herein.

In the embodiments, the pulse amplitude modulation unit PAM includes a first drive transistor T1 connected to the anode of the light-emitting element LED and the high-potential power supply VDD, and a pulse amplitude modulation circuit connected to a control end of the first drive transistor T1. The first drive transistor T1 provides driving currents with different amplitudes to the light-emitting element LED according to a voltage applied at the control end by the pulse amplitude modulation circuit.

The pulse width modulation unit PWM includes a second drive transistor T2 connected to the anode of the light-emitting element LED and the pulse amplitude modulation unit PAM, a first transistor T3 and a second transistor T4 connected to a control end of the second drive transistor T2, and a pulse width modulation circuit connected to a control end of the first transistor T3 and a control end of the second transistor T4.

Specifically, a first end of the first transistor T3 is connected to the high-potential power supply VDD, a second end of the first transistor T3 is connected to a first end of the second transistor T4, and the control end of the first transistor T3 is connected to the pulse width modulation circuit; a second end of the second transistor T4 is connected to the low-potential power supply VSS, and the control end of the second transistor T4 is connected to the pulse width modulation circuit. A point where the pulse width modulation circuit is connected to the control end of the first transistor T3 and the control end of the second transistor T4 is defined as a first node A, and a point where the second end of the first transistor T3 is connected to the first end of the second transistor T4 is defined as a second node B.

The second drive transistor T2 is of the same type as the first transistor T3, and one of the first transistor T3 and the second transistor T4 is a P-type transistor and the other is an N-type transistor; the pulse width modulation circuit is connected to a first data line L1 and outputs first data voltages Vdata_1 of different voltage levels based on the first data line L1 during a luminescence phase, thereby generating corresponding drive signals to control the first transistor T3 or second transistor T4 to be turned on, and thus controlling the second drive transistor T2 to be turned on, thereby controlling the duration of the driving current I of the light-emitting element LED, that is, the luminescence time and duration of the light-emitting element LED.

In the embodiments, the first drive transistor T1, the second drive transistor T2, and the first transistor T3 are each a P-type transistor, and the second transistor T4 is an N-type transistor. The source (first end) of the first drive transistor T1 is connected to the high-potential power supply VDD, the drain (second end) of the first drive transistor T1 is connected to the source (first end) of the second drive transistor T2, and the gate (control end) of the first drive transistor T1 is connected to the pulse amplitude modulation circuit; the drain (second end) of the second drive transistor T2 is connected to the anode of the light-emitting element LED, and the gate (control end) of the second drive transistor T2 is connected to the drain (second end) of the first transistor T3 and the drain (first end) of the second transistor T4; the source (first end) of the first transistor T3 is connected to the high-potential power supply VDD, and the gate (control end) of the first transistor T3 is connected to the pulse width modulation circuit; the source (second end) of the second transistor T4 is connected to the low-potential power supply VSS, and the gate (control end) of the second transistor T4 is connected to the pulse width modulation circuit; the cathode of the light-emitting element LED is connected to the low-potential power supply VSS.

In other embodiments, when the first transistor T3 is an N-type transistor, the second drive transistor T2 is also an N-type transistor, while the second transistor T4 is a P-type transistor, and the first drive transistor may be a P-type transistor or an N-type transistor. There is no limitation in this regard, and the specific connection relationship is determined according to the type of each transistor.

The beneficial effect of the present embodiments is that the first transistor T3 and the second transistor T4 are arranged to be different types of transistors, such that they can be turned on or off respectively based on different drive signals generated by the pulse width modulation circuit, and then control the second driving transistor T2 to be turned on when the first transistor T3 or the second transistor T4 is turned on. In this way, the pulse width regulation may be realized, such that the light-emitting element LED may maintain in the high-efficiency working range, facilitating the realization of gray-scale cutting.

Figure 2:
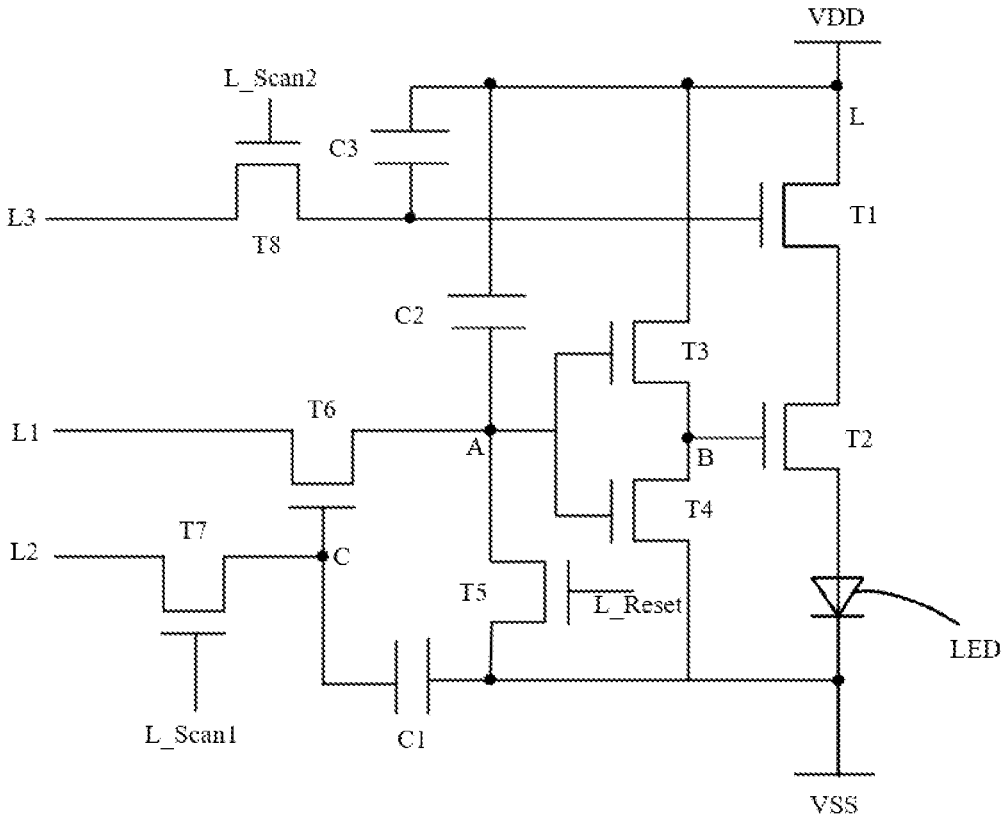
FIG. 2 is a structural schematic view of a pixel drive circuit according to a first embodiment of the present disclosure.

Combined with FIG. 2, FIG. 2 is a structural schematic view of a pixel drive circuit according to a first embodiment of the present disclosure.

In the embodiments, the pulse width modulation unit PWM further includes a reset transistor T5, a first end of the reset transistor T5 is connected to the first node A, a second end of the reset transistor T5 is connected to the low-potential power supply VSS, and a control end of the reset transistor T5 is connected to the reset control line L_Reset. The reset control line L_Reset is configured to output a reset signal Reset during a reset phase, for controlling the reset transistor T5 to be turned on, thereby writing a low-potential voltage to the first node A. By resetting the first node A before each luminescence phase, the control ends of the first transistor T3 and the second transistor T4 have the same collimated voltage to facilitate the regulation of the pulse width and avoid the uncontrolled duration of light-emitting element LED at each light emission.

In the embodiments, the reset transistor T5 is a P-type transistor, the source (second end) of the reset transistor T5 is connected to the low-potential power supply VSS, the drain (first end) of the reset transistor T5 is connected to the first node A, and the gate (control end) of the reset transistor T5 is connected to the reset control line L_Reset. Of course, in other embodiments, the reset transistor T5 may be an N-type transistor, without limitation herein.

Of course, in other embodiments, the reset transistor T5 may be omitted, without limitation herein.

In the embodiments, the pulse width modulation circuit includes a third transistor T6, a fourth transistor T7, and a first capacitor C1.

A first end of the third transistor T6 is connected to the first data line L1 to receive the first data voltages Vdata_1 of different voltage levels output from the first data line L1 during the luminescence phase, and a second end of the third transistor T6 is connected to the first node A.

A first end of the fourth transistor T7 is connected to a second data line L2 to receive a second data voltage Vdata_2 output from the second data line L2 during a data writing phase, a second end of the fourth transistor T7 is connected to a control end of the third transistor T6 to write the second data voltage Vdata_2 to the control end of the third transistor T6, and a control end of the fourth transistor T7 is connected to a first scan control line L_Scan1. The first scan control line L_Scan1 is configured to output a first scan signal PWM_Scan during the data writing phase to control the fourth transistor T7 to be turned on, thereby writing the second data voltage Vdata_2 to the control end of the third transistor T6. A point where the second end of the fourth transistor T7 is connected to the control end of the third transistor T6 is defined as a third node C.

A first pole plate of the first capacitor C1 is connected to the low-potential power supply VSS, and a second pole plate of the first capacitor C1 is connected to the control end of the third transistor T6. The first capacitor C1 is configured to maintain a voltage charged by the fourth transistor T7 to the control end of the third transistor T6.

In the embodiments, the third transistor T6 and the fourth transistor T7 are each a P-type transistor, the source (first end) of the third transistor T6 is connected to the first data line L1, the drain (second end) of the third transistor T6 is connected to the first node A, and the gate (control end) of the third transistor T6 is connected to the drain (second end) of the fourth transistor T7; the source (first end) of the fourth transistor T7 is connected to the second data line L2, and the gate (control end) of the third transistor T6 is connected to the first scan control line L_Scan1.

Of course, in other embodiments, the third transistor T6 and the fourth transistor T7 may be N-type transistors, without limitation herein.

In the embodiments, the pulse width modulation circuit further includes a second capacitor C2. A first pole plate of the second capacitor C2 is connected to the high-potential power supply VDD, and a second pole plate of the second capacitor C2 is connected to the first node A. The second capacitor C2 is configured to maintain a voltage charged by the third transistor T6 to the control end of the first transistor T3 or the control end of the second transistor T4 during the reset phase and the data writing phase.

In the embodiments, the pulse amplitude modulation circuit includes a fifth transistor T8 and a third capacitor C3.

A first end of the fifth transistor T8 is connected to a third data line L3 to receive a third data voltage Vdata_3 output from the third data line L3 during the data writing phase, a second end of the fifth transistor T8 is connected to the control end of the first drive transistor T1, and a control end of the fifth transistor T8 is connected to a second scan control line L_Scan2. Specifically, the second scan control line L_Scan2 is configured to output a second scan signal PAM_Scan during the data writing phase to control the fifth transistor T8 to be turned on, thereby writing the third data voltage Vdata_3 to the control end of the first drive transistor T1.

A first pole plate of the third capacitor C3 is connected to the high-potential power supply VDD, and a second pole plate of the third capacitor C3 is connected to the control end of the first drive transistor T1.

In the embodiments, the fifth transistor T8 is a P-type transistor, the source (first end) of the fifth transistor T8 is connected to the third data line L3, the drain (second end) of the fifth transistor T8 is connected to the gate of the first drive transistor T1, and the gate (control end) of the fifth transistor T8 is connected to the second scan control line L_Scan2. Of course, in other embodiments, the fifth transistor T8 may be an N type transistor, without limitation herein.

In other embodiments of the pulse amplitude modulation unit PAM, the structure of the fifth transistor T8 and the third capacitor C3 may be omitted. For example, some additional transistors, elements, and alignments may be arranged to achieve compensation and other functions.

Figure 3:
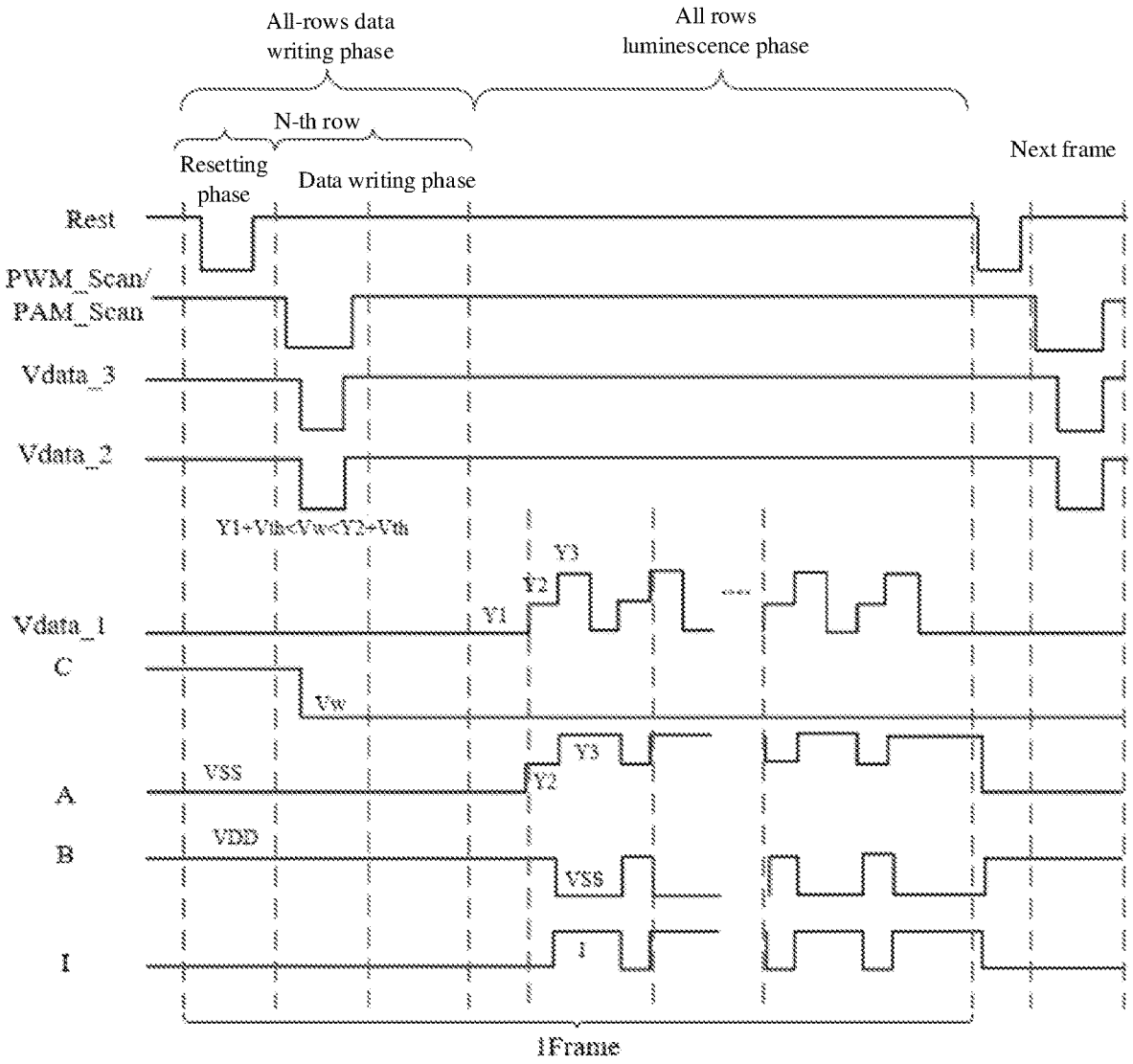
FIG. 3 is a timing diagram of drive signals of a pixel drive circuit according to an embodiment of the present disclosure.

Combining FIG. 2 and FIG. 3, FIG. 3 is a timing diagram of drive signals of a pixel drive circuit according to an embodiment of the present disclosure. For illustration, the first transistor T3, the second drive transistor T2, the third transistor T6, the fourth transistor T7, and the fifth transistor T8 are P-type transistors, and the second transistor T4 is an N-type transistor, as an example.

During the reset phase, the reset control line L_Reset outputs the reset signal Reset to control the reset transistor T5 to be turned on, thereby writing a low-potential voltage to the first node A. In this case, since the first transistor T3 is a P-type transistor and the second transistor T4 is an N-type transistor, the first transistor T3 is turned on while the second transistor T4 is turned off, and a high-potential voltage is written to the second node B; while the second drive transistor T2 is a P-type transistor, and the second drive transistor T2 is turned off.

During the data writing phase, the second scan control line L_Scan2 controls the fifth transistor T8 to be turned on, the third data line L3 writes the third data voltage Vdata_3 to the control end of the first drive transistor T1 through the fifth transistor T8, and the third data voltage Vdata_3 can turn on the first drive transistor T1 by the controlled current amplitude. In addition, the first scan control line L_Scan1 controls the fourth transistor T7 to be turned on, the second data line L2 writes the second data voltage Vdata_2 to the control end of the third transistor T6 through the fourth transistor T7, and the second drive transistor T2 is turned off because the control end (second node B) of the second drive transistor T2 is still at a high-potential voltage at this time.

During the luminescence phase, the first data line L1 inputs the first data voltages Vdata_1 of different voltage levels to the first end of the third transistor T6. Since the voltage at the control end of the third transistor T6 is the second data voltage Vdata_2, according to the conduction principle of the P-type transistor, when a voltage sum of the first data voltage Vdata_1 of a certain voltage level output by the first data line L1 and a threshold voltage Vth of third transistor T6 is less than the second data voltage Vdata_2, the third transistor T6 is turned off, i.e., the first data voltage Vdata_1 of this voltage level is not written to the first node A; when the voltage sum of the first data voltage Vdata_1 of a certain voltage level output by the first data line L1 and the threshold voltage Vth of the third transistor T6 is greater than the second data voltage Vdata_2, the third transistor T6 is turned on, i.e., the first data voltage Vdata_1 of this voltage level is written to the first node A. The first transistor T3 and the second transistor T4 are turned on based on the first data voltages Vdata_1 of different voltage levels written to the first node A, respectively, and when the second transistor T4 is turned on based on the first data voltage Vdata_1 written to the first node A, the low-potential voltage in the low-potential power supply VSS is written to the second node B through the second transistor T4, the second drive transistor T2 is turned on, and the light-emitting element LED emits light.

A first stage of the luminescence phase is defined when the first transistor T3 is turned on based on the first data voltages Vdata_1 of different voltage levels written to the first node A; and a second stage of the luminescence phase is defined when the second transistor T4 is turned on based on the first data voltages Vdata_1 of different voltage levels written to the first node A.

It can be understood that the turned-on time of the second drive transistor T2 is associated with the magnitude of the second data voltage Vdata_2 and the magnitude of the first data voltages Vdata_1 of different levels.

Specifically, referring to FIG. 4, FIG. 4 is a correspondence schematic view between a first data voltage, a third data voltage, and a gray scale according to an embodiment of the present disclosure. In the present disclosure, the control on the control end of the first drive transistor T1 in the pulse amplitude modulation unit PAM is divided into n levels, and its corresponding third data voltages Vdata_3 are X1~Xn voltages, respectively. These different voltages can realize different amplitudes of the current flowing through the first drive transistor T1, thereby realizing the pulse amplitude control of the driving current I. The control on the control end of the second drive transistor T2 in the pulse width modulation unit PWM is divided into m levels, and its corresponding first data voltages Vdata_1 are Y1~Ym voltages respectively. These different voltages can realize different widths of the current flowing through the second drive transistor T2, thereby realizing the pulse width control of the driving current I. By controlling the pulse width and amplitude of the driving current I from the high-potential power supply VDD to the low potential-power supply VSS respectively, the display of 0 to 255 gray levels is realized (Gray Level in the present disclosure with 8 bit as an example). The pulse width and pulse amplitude of the driving current I corresponding to each gray level may be selected according to the requirement of the display parameters for the pulse width and pulse amplitude voltages corresponding to the first drive transistor T1 and the second drive transistor T2, respectively.

Combining FIG. 3 and FIG. 5, FIG. 5 is a correspondence schematic view between a first data voltage, a third data voltage, and a gray scale according to another embodiment of the present disclosure. In the present disclosure, the first data voltages Vdata_1 of different voltage levels are divided into 3 voltage levels (Y1, Y2, Y3 in step increments and with same duration), and the third data voltage Vdata_3 into n voltages for illustration, thereby realizing the display of 8 bit gray scale.

Specifically, during the data writing phase, the second data line L2 writes the second data voltage Vdata_2 to the control end of the third transistor T6 through the fourth transistor T7, where the voltage of the second data voltage Vdata_2 is Vw, i.e., the voltage of the third node C is Vw.

During the luminescence phase, the first data line L1 writes the first data voltage Vdata_1 of the three voltage levels to the first end of the third transistor T6. When Y1+Vth<Vw<Y2+Vth is set, where Vth is the threshold voltage of the third transistor T6, Y1 will not be written to the first node A. Therefore, the first node A will maintain at the Y3 voltage at the time duration corresponding to Y1. The voltages of Y1, Y2 and Y3 are selected, such that Y1 and Y2 can ensure that the first transistor T3 is turned on and the second transistor T4 is turned off; Y3 can ensure that the first transistor T3 is turned off and the second transistor T4 is turned on. In this way, by writing Vw at the first node A, the current pulse width of the second drive transistor T2 is ⅔.

When Vw<Y1+Vth is set, Y1, Y2 and Y3 can all be written to the first node A, such that the current pulse width of the second drive transistor T2 is ⅓.

When Y2+Vth<Vw<Y3+Vth is set, only Y3 can be written to the first node A, such that the current pulse width of the second drive transistor T2 is 100%.

Of course, in other specific implementations, the first data voltages Vdata_1 of different voltage levels may be divided into more voltage levels, which are not limited herein and may be set according to actual needs. For example, the first data voltages Vdata_1 of different voltage levels are divided into 4 voltage levels (Y1, Y2, Y3, Y4 in step increments and with same duration).

During the luminescence phase, the first data line L1 writes the first data voltage Vdata_1 of the four voltage levels to the first end of the third transistor T6. When Y1+Vth<Vw<Y2+Vth is set, Y1 will not be written to the first node A. Therefore, the first node A will maintain at the Y4 voltage at the time duration corresponding to Y1. The voltage selection of Y1, Y2, Y3, Y4 are selected, such that Y1, Y2, Y3, Y4 Y2, Y3 can ensure that the first transistor T3 is turned on and the second transistor T4 is turned off; Y4 can ensure that the first transistor T3 is turned off and the second transistor T4 is turned on. In this way, by writing Vw at the first node A, the current pulse width of the second drive transistor T2 is ½.

When Vw<Y1+Vth is set, Y1, Y2, Y3 and Y4 can be written to the first node A, such that the current pulse width of the second drive transistor T2 is ¼.

When Y2+Vth<Vw<Y3+Vth is set, Y3 and Y4 can be written to the first node A, such that the current pulse width of the second drive transistor T2 is ¾.

When Y3+Vth<Vw<Y4+Vth is set, only Y4 can be written to the first node A, such that the current pulse width of the second drive transistor T2 is 100%.

In other embodiments, different voltage levels in the first data voltage Vdata_1 may be stepped down, and the duration of the different voltage levels in the first data voltage Vdata_1 may be different, which is not limited herein and may be selected according to the needs.

Specifically, the beneficial effect of the pixel drive circuit provided by the first embodiment of the present disclosure is that, in contrast to the related art, the third data voltages Vdata_3 output from the third data line L3 control the control end of the first drive transistor T1 in the pulse amplitude modulation unit PAM in n levels, and these different voltages can achieve different amplitudes of the current flowing through the first drive transistor T1, thereby achieving pulse amplitude control of the driving current I. The first data voltages Vdata_1 output from the first data line L1 control the control end of the second drive transistor T2 in the pulse width modulation unit PWM in m levels, and these different voltages can achieve different widths of the current flowing through the second drive transistor T2, thereby realizing the pulse width control of the driving current I. By controlling the pulse width and amplitude of the driving current I from the high-potential power supply VDD to the low-potential power supply VSS respectively, the light-emitting element LED can always be in the high-efficiency working range, facilitating the realization of gray-scale cutting, thus realizing the display of 0~255 gray scale.

Figure 6:
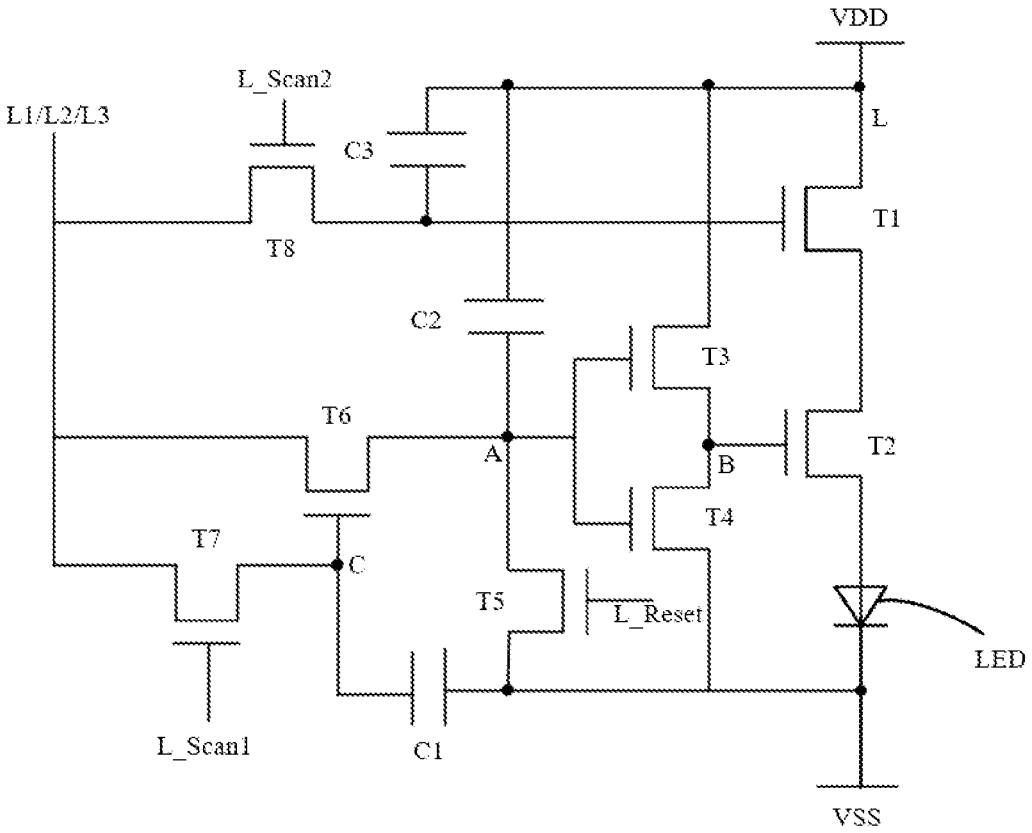
FIG. 6 is a structural schematic view of a pixel drive circuit according to a second embodiment of the present disclosure.
Figure 7:
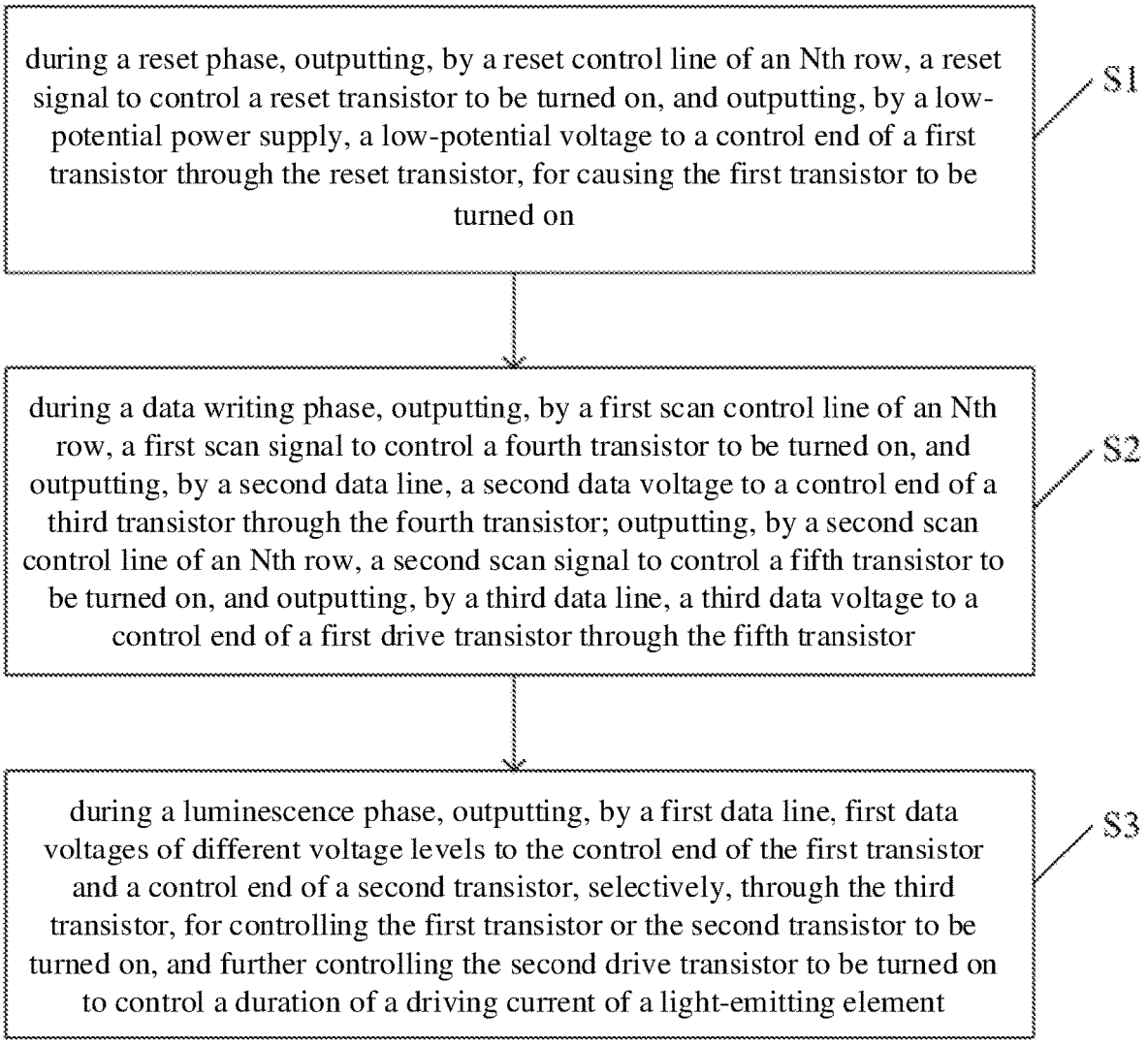
FIG. 7 is a flowchart of a driving method of a pixel drive circuit according to an embodiment of the present disclosure.

Referring to FIG. 6, FIG. 6 is a structural schematic view of a pixel drive circuit according to a second embodiment of the present disclosure. In the second embodiment of the present disclosure, the pixel drive circuit has almost the same structure as the pixel drive circuit provided in the first embodiment, and the difference from the first embodiment is that the first data line L1, the second data line L2, and the third data line L3 are the same data line. Specifically, the first data line L1, the second data line L2, and the third data line L3 are time-multiplexed, such that the wiring area may be reduced, which is conducive to the narrow bezel design of the display panel.

Figure 8:
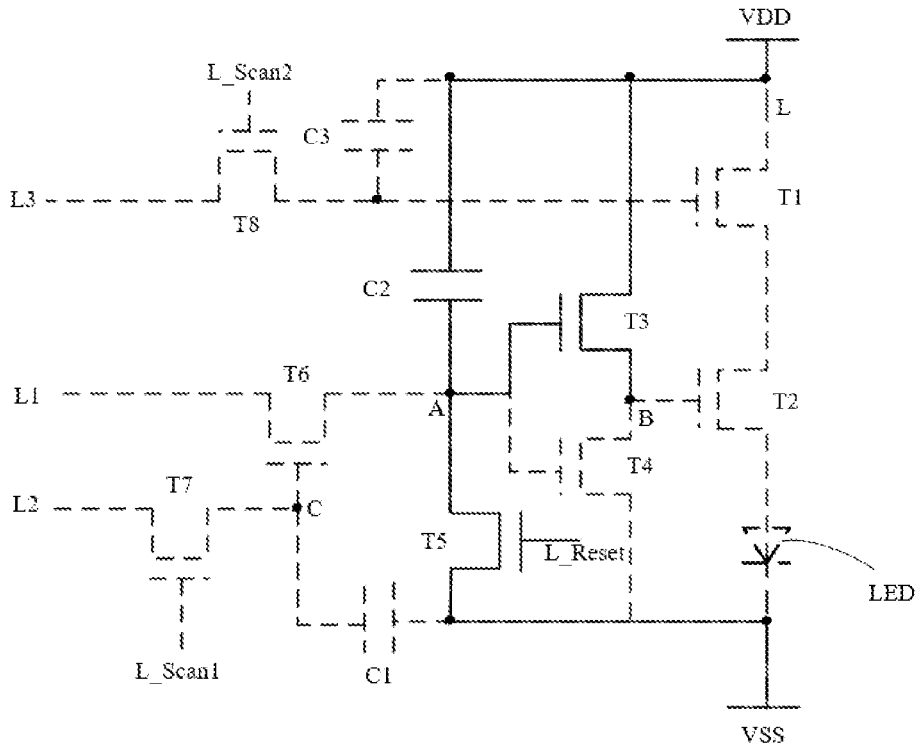
FIG. 8 is an equivalent circuit diagram of a driving method of a pixel drive circuit during a reset phase according to an embodiment of the present disclosure.
Figure 9:
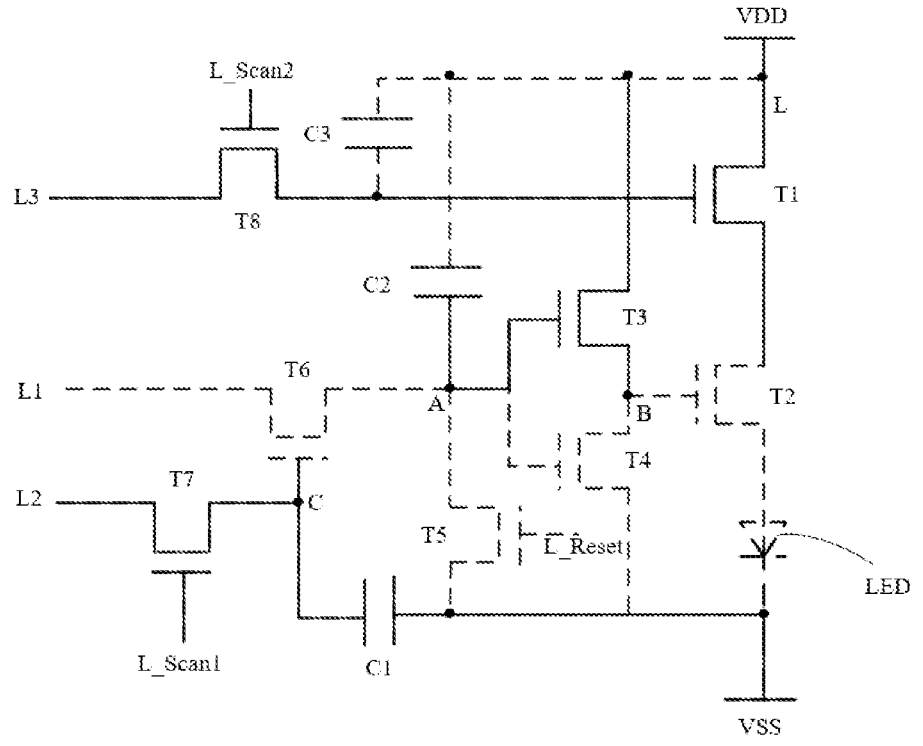
FIG. 9 is an equivalent circuit diagram of a driving method of a pixel drive circuit during a data writing phase according to an embodiment of the present disclosure.
Figure 10:
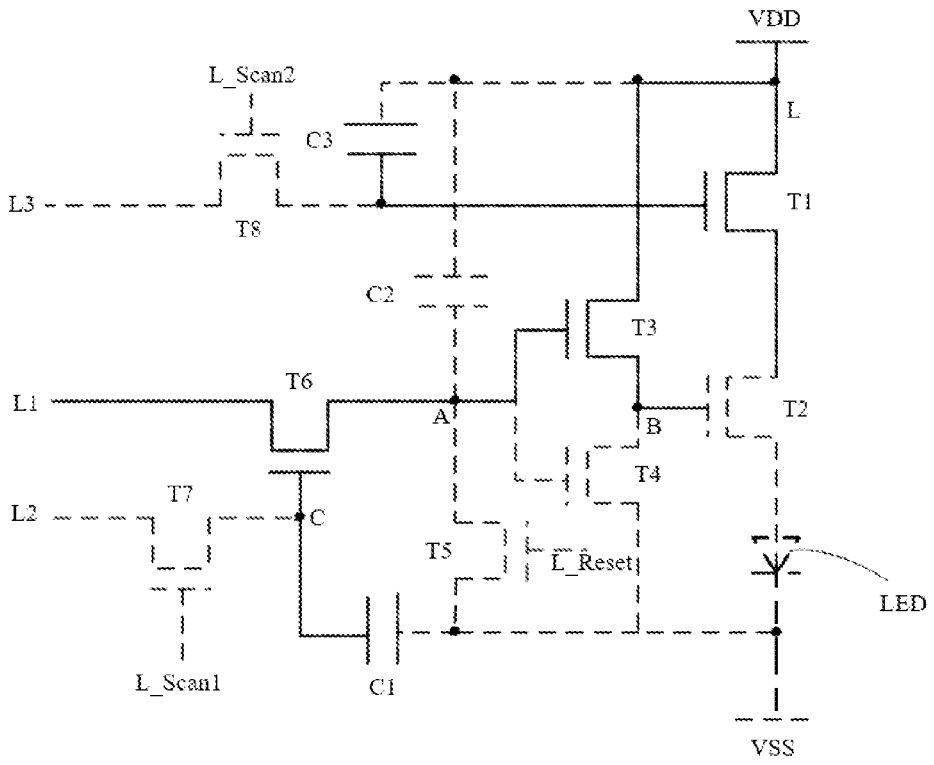
FIG. 10 is an equivalent circuit diagram of a driving method of a pixel drive circuit in a first stage during a luminescence phase according to an embodiment of the present disclosure.
Figure 11:
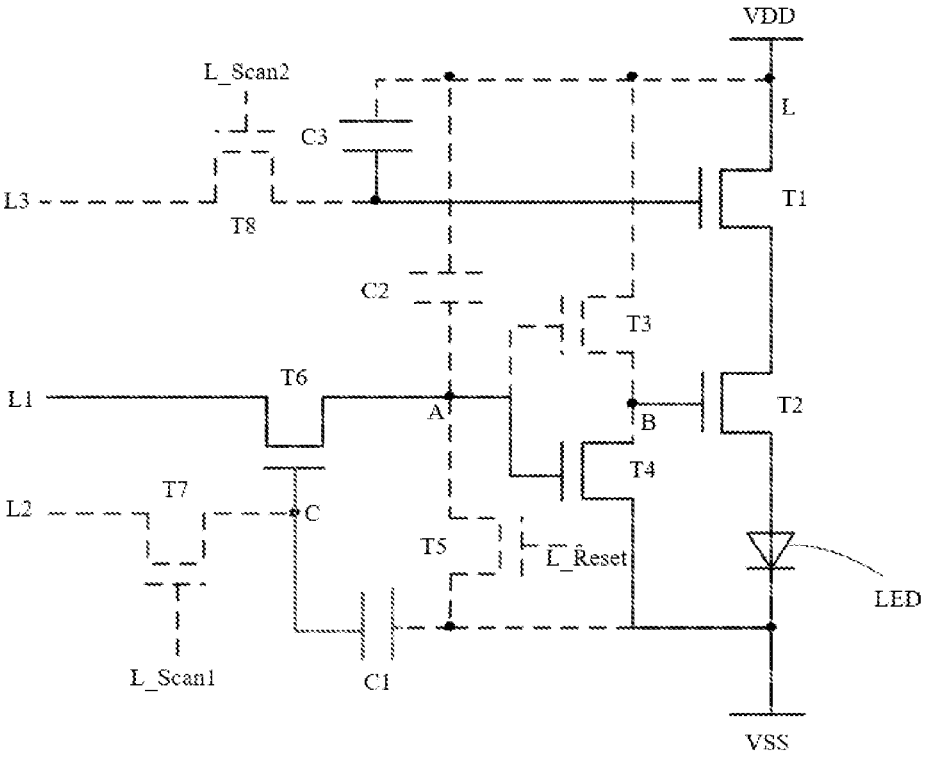
FIG. 11 is an equivalent circuit diagram of a driving method of a pixel drive circuit in a second stage during a luminescence phase according to an embodiment of the present disclosure.

Referring to FIGS. 7 to 11, FIG. 7 is a flowchart of a driving method of a pixel drive circuit according to an embodiment of the present disclosure; FIG. 8 is an equivalent circuit diagram of a driving method of a pixel drive circuit during a reset phase according to an embodiment of the present disclosure; FIG. 9 is an equivalent circuit diagram of a driving method of a pixel drive circuit during a data writing phase according to an embodiment of the present disclosure; FIG. 10 is an equivalent circuit diagram of a driving method of a pixel drive circuit in a first stage during a luminescence phase according to an embodiment of the present disclosure; and FIG. 11 is an equivalent circuit diagram of a driving method of a pixel drive circuit in a second stage during a luminescence phase according to an embodiment of the present disclosure.

The present disclosure further provides a driving method of a pixel drive circuit, applied to the pixel drive circuit provided in any of the above embodiments. The driving method includes operations at blocks illustrated in FIG. 7.

At block S1: during a reset phase, outputting, by a reset control line of an Nth row, a reset signal to control a reset transistor to be turned on, and outputting, by a low-potential power supply, a low-potential voltage to a control end of a first transistor through the reset transistor, for causing the first transistor to be turned on.

For illustration, the first transistor T3, the second drive transistor T2, the third transistor T6, the fourth transistor T7, and the fifth transistor T8 are each a P-type transistor, and the second transistor T4 is an N-type transistor as an example.

Referring to FIG. 8, during the reset phase, the reset control line L_Reset outputs the reset signal Reset to control the reset transistor T5 to be turned on, and a low-potential voltage is written to the first node A. In this case, since the first transistor T3 is a P-type transistor and the second transistor T4 is an N-type transistor, the first transistor T3 is turned on while the second transistor T4 is turned off, and a high-potential voltage is written to the second node B; while the second drive transistor T2 is a P-type transistor, and the second drive transistor T2 is turned off.

At block S2: during a data writing phase, outputting, by a first scan control line of an Nth row, a first scan signal to control a fourth transistor to be turned on, and outputting, by a second data line, a second data voltage to a control end of a third transistor through the fourth transistor; outputting, by a second scan control line of an Nth row, a second scan signal to control a fifth transistor to be turned on, and outputting, by a third data line, a third data voltage to a control end of a first drive transistor through the fifth transistor.

Referring to FIG. 9, specifically, during the data writing phase, the second scan control line L_Scan2 controls the fifth transistor T8 to be turned on, and the third data line L3 writes the third data voltage Vdata_3 to the control end of the first drive transistor T1 through the fifth transistor T8, and the third data voltage Vdata_3 can turn on the first drive transistor T1 by the controlled current amplitude. In addition, the first scan control line L_Scan1 controls the fourth transistor T7 to be turned on, the second data line L2 writes the second data voltage Vdata_2 to the control end of the third transistor T6 through the fourth transistor T7, and the second drive transistor T2 is turned off because the control end (second node B) of the second drive transistor T2 is still at a high-potential voltage at this time.

At block S3: during a luminescence phase, outputting, by a first data line, first data voltages of different voltage levels to the control end of the first transistor and a control end of a second transistor, selectively, through the third transistor, for controlling the first transistor or the second transistor to be turned on, and further controlling the second drive transistor to be turned on to control a duration of a driving current of a light-emitting element.

Referring to FIG. 10 and FIG. 11, specifically, during the luminescence phase, the first data line L1 inputs the first data voltages Vdata_1 of different voltage levels to the first end of the third transistor T6. Since the voltage at the control end of the third transistor T6 is the second data voltage Vdata_2, according to the conduction principle of the P-type transistor, when a voltage sum of the first data voltage Vdata_1 of a certain voltage level output by the first data line L1 and a threshold voltage Vth of third transistor T6 is less than the second data voltage Vdata_2, the third transistor T6 is turned off, i.e., the first data voltage Vdata_1 of this voltage level is not written to the first node A; when the voltage sum of the first data voltage Vdata_1 of a certain voltage level output by the first data line L1 and the threshold voltage Vth of the third transistor T6 is greater than the second data voltage Vdata_2, the third transistor T6 is turned on, i.e., the first data voltage Vdata_1 of this voltage level is written to the first node A. The first transistor T3 and the second transistor T4 are turned on based on the first data voltages Vdata_1 of different voltage levels written to the first node A, respectively, and when the second transistor T4 is turned on based on the first data voltage Vdata_1 written to the first node A, the low-potential voltage in the low-potential power supply VSS is written to the second node B through the second transistor T4, the second drive transistor T2 is turned on, and the light-emitting element LED receives the driving current I and emits light. It can be understood that the pulse width modulation circuit controls the duration of the driving current I of the light-emitting element LED by controlling the conduction of the first transistor T3 or the second transistor T4, which in turn controls the second drive transistor T2 to be turned on, thereby controlling the duration of the driving current I of the light-emitting element LED, that is, the luminescence time and duration of the light-emitting element LED.

A first stage of the luminescence phase is defined when the first transistor T3 is turned on based on the first data voltages Vdata_1 of different voltage levels written to the first node A; and a second stage of the luminescence phase is defined when the second transistor T4 is turned on based on the first data voltages Vdata_1 of different voltage levels written to the first node A.

Specifically, in the driving method of the pixel drive circuit provided in the present disclosure, the pulse width modulation circuit controls the first transistor T3 and the second transistor T4 to be turned on or off based on different drive signals generated by the first data voltages Vdata_1 of different voltage levels outputted by the first data line L1 during the luminescence phase, and then controls the second driving transistor T2 to be turned on when the first transistor T3 or the second transistor T4 is turned on. In this way, the pulse width regulation may be realized, such that the light-emitting element LED may maintain in the high-efficiency working range, facilitating the realization of gray-scale cutting.

During the luminescence phase, the first data line L1 inputs the first data voltages Vdata_1 of different voltage levels to the first end of the third transistor T6. Since the voltage at the control end (gate) of the third transistor T6 is the second data voltage Vdata_2, according to the conduction principle of the P-type transistor, when a voltage sum of the first data voltage Vdata_1 of a certain voltage level output by the first data line L1 and a threshold voltage Vth of third transistor T6 is less than the second data voltage Vdata_2, the third transistor T6 is turned off, i.e., the first data voltage Vdata_1 of this voltage level is not written to the first node A; when the voltage sum of the first data voltage Vdata_1 of a certain voltage level output by the first data line L1 and the threshold voltage Vth of the third transistor T6 is greater than the second data voltage Vdata_2, the third transistor T6 is turned on, i.e., the first data voltage Vdata_1 of this voltage level is written to the first node A. The first transistor T3 and the second transistor T4 are turned on based on the first data voltages Vdata_1 of different voltage levels written to the first node A, respectively, and when the second transistor T4 is turned on based on the first data voltage Vdata_1 written to the first node A, the low-potential voltage in the low-potential power supply VSS is written to the second node B through the second transistor T4, the second drive transistor T2 is turned on, and the light-emitting element LED emits light. Therefore, it can be understood that the turned-on time of the second drive transistor T2 is associated with the magnitude of the second data voltage Vdata_2 and the magnitude of the first data voltages Vdata_1 of different levels.

In some embodiments, different voltage levels of the first data voltages Vdata_1 are stepped up or stepped down, which is not limited herein and may be as long as the pulse width modulation effect can be achieved.

In some embodiments, the duration of different voltage levels in the first data voltages Vdata_1 is the same, the purpose of which is to facilitate the calculation. Of course, it is also possible to set the duration of the different voltage levels in the first data voltages Vdata_1 not exactly the same or completely different, without limitation herein.

Figure 12:
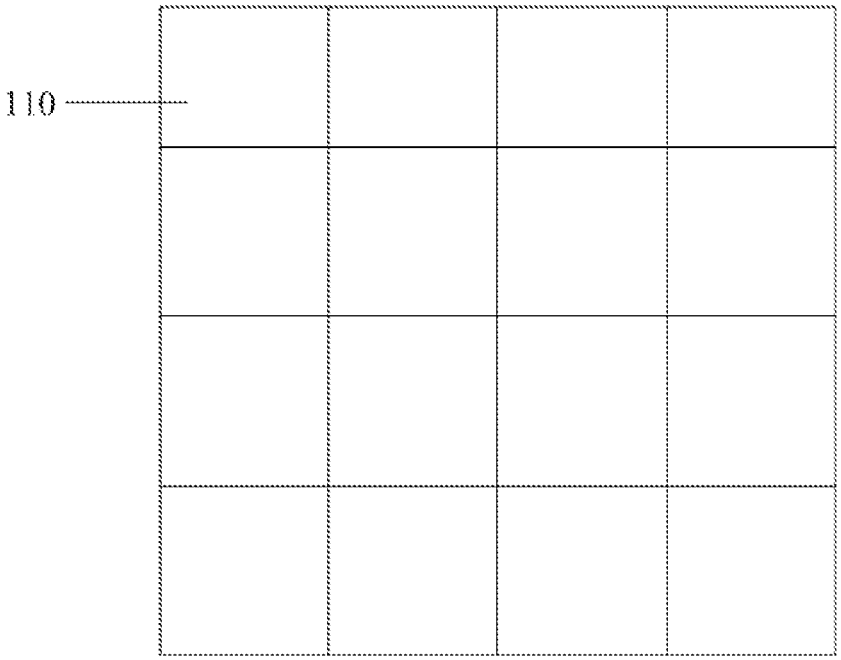
FIG. 12 is a structural schematic view of a display panel according to an embodiment of the present disclosure.

Referring to FIG. 12, FIG. 12 is a structural schematic view of a display panel according to an embodiment of the present disclosure. Specifically, the present disclosure further provides a display panel, the display panel includes multiple pixel cells 110 arranged in an array, and each pixel cell 110 is arranged with a pixel drive circuit in any of the above embodiments.

The above is only an embodiment of the present disclosure and is not intended to limit the scope of the present disclosure. Any equivalent structure or equivalent process transformation made by using the contents of the specification and the accompanying drawings of the present disclosure, or applied directly or indirectly in other related technical fields, are included in the scope of the present disclosure.

What is claimed is:

1. A pixel drive circuit, comprising:

a power supply line, comprising a high-potential power supply and a low-potential power supply;

a light-emitting element; connected between the high-potential power supply and the low-potential power supply;

a pulse amplitude modulation unit, comprising: a first drive transistor connected to an anode of the light-emitting element and the high-potential power supply, and a pulse amplitude modulation circuit connected to a control end of the first drive transistor; wherein the first drive transistor is configured to provide driving currents with different amplitudes to the light-emitting element according to a voltage applied at the control end by the pulse amplitude modulation circuit; and a pulse width modulation unit, comprising:

a second drive transistor, connected to the anode of the light-emitting element and the pulse amplitude modulation unit;

a first transistor and a second transistor, connected to a control end of the second drive transistor;

a pulse width modulation circuit, connected to a control end of the first transistor and a control end of the second transistor; wherein a first end of the first transistor is connected to the high-potential power supply, a second end of the first transistor is connected to a first end of the second transistor, and the control end of the first transistor is connected to the pulse width modulation circuit; a second end of the second transistor is connected to the low-potential power supply, and the control end of the second transistor is connected to the pulse width modulation circuit;

a third transistor; wherein a first end of the third transistor is connected to a first data line to receive first data voltages of different voltage levels output from the first data line, and a second end of the third transistor is connected to a first node;

a fourth transistor; wherein a first end of the fourth transistor is connected to a second data line to receive a second data voltage output from the second data line, a second end of the fourth transistor is connected to a control end of the third transistor, and a control end of the fourth transistor is connected to a first scan control line; and a first capacitor; wherein a first pole plate of the first capacitor is connected to the low-potential power supply, and a second pole plate of the first capacitor is connected to the control end of the third transistor;

wherein the second drive transistor is of a same type as the first transistor, one of the first transistor and the second transistor being a P-type transistor, and the other of the first transistor and the second transistor being an N-type transistor; the pulse width modulation circuit is configured to output the first data voltages of different voltage levels with the first data line during a luminescence phase, for generating corresponding drive signals to control the first transistor or second transistor to be turned on, and controlling the second drive transistor to be turned on to control a duration of the driving currents of the light-emitting element.

2. The pixel drive circuit according to claim 1, wherein the pulse width modulation unit further comprises a reset transistor; a first end of the reset transistor is connected to the first node, a second end of the reset transistor is connected to the low-potential power supply, and a control end of the reset transistor is connected to a reset control line; wherein the first node is a point where the pulse width modulation circuit is connected to the control end of the first transistor and the control end of the second transistor.

3. The pixel drive circuit according to claim 1, wherein the third transistor is a P-type transistor; for one of the first data voltages of different voltage levels, in response to a voltage sum of the first data voltage of a voltage level output and a threshold voltage of third transistor being less than the second data voltage, the third transistor is turned off; in response to the voltage sum of the first data voltage of the voltage level and the threshold voltage of the third transistor being greater than the second data voltage, the third transistor is turned on;

wherein a turned-on time of the second drive transistor is associated with a magnitude of the second data voltage and a magnitude of the first data voltages of different levels.

4. The pixel drive circuit according to claim 1, wherein the pulse width modulation circuit further comprises a second capacitor; a first pole plate of the second capacitor is connected to the high-potential power supply, and a second pole plate of the second capacitor is connected to the first node.

5. The pixel drive circuit according to claim 1, wherein the pulse amplitude modulation circuit comprises a fifth transistor and a third capacitor;

a first end of the fifth transistor is connected to a third data line, a second end of the fifth transistor is connected to the control end of the first drive transistor, and a control end of the fifth transistor is connected to a second scan control line;

a first pole plate of the third capacitor is connected to the high-potential power supply, and a second pole plate of the third capacitor is connected to the control end of the first drive transistor.

6. The pixel drive circuit according to claim 1, wherein the pulse amplitude modulation circuit comprises a fifth transistor; a first end of the fifth transistor is connected to a third data line, a second end of the fifth transistor is connected to the control end of the first drive transistor, and a control end of the fifth transistor is connected to a second scan control line;

wherein the first data line, the second data line, and the third data line are multiplexed.

7. The pixel drive circuit according to claim 1, wherein the different voltage levels of the first data voltages are stepped up or stepped down.

8. The pixel drive circuit according to claim 1, wherein the duration of the different voltage levels of the first data voltages is the same.

9. A driving method of a pixel drive circuit; wherein the pixel drive circuit comprises:

a power supply line, comprising a high-potential power supply and a low-potential power supply;

a light-emitting element; connected between the high-potential power supply and the low-potential power supply;

a pulse amplitude modulation unit, comprising: a first drive transistor connected to an anode of the light-emitting element and the high-potential power supply, and a pulse amplitude modulation circuit connected to a control end of the first drive transistor; and a pulse width modulation unit, comprising:

a second drive transistor, connected to the anode of the light-emitting element and the pulse amplitude modulation unit;

a first transistor and a second transistor, connected to a control end of the second drive transistor;

a pulse width modulation circuit, connected to a control end of the first transistor and a control end of the second transistor; wherein a first end of the first transistor is connected to the high-potential power supply, a second end of the first transistor is connected to a first end of the second transistor, and the control end of the first transistor is connected to the pulse width modulation circuit; a second end of the second transistor is connected to the low-potential power supply, and the control end of the second transistor is connected to the pulse width modulation circuit;

a third transistor; wherein a first end of the third transistor is connected to a first data line to receive first data voltages of different voltage levels output from the first data line, and a second end of the third transistor is connected to a first node;

a fourth transistor; wherein a first end of the fourth transistor is connected to a second data line to receive a second data voltage output from the second data line, a second end of the fourth transistor is connected to a control end of the third transistor, and a control end of the fourth transistor is connected to a first scan control line; and a first capacitor; wherein a first pole plate of the first capacitor is connected to the low-potential power supply, and a second pole plate of the first capacitor is connected to the control end of the third transistor;

wherein the second drive transistor is of a same type as the first transistor, one of the first transistor and the second transistor being a P-type transistor, and the other of the first transistor and the second transistor being an N-type transistor;

wherein the method comprises:

during a reset phase, providing, by the first drive transistor, driving currents with different amplitudes to the light-emitting element according to a voltage applied at the control end by the pulse amplitude modulation circuit; and during a luminescence phase, outputting, by the pulse width modulation circuit, the first data voltages of different voltage levels with the first data line, for generating corresponding drive signals to control the first transistor or second transistor to be turned on and controlling the second drive transistor to be turned on to control a duration of the driving currents of the light-emitting element.

10. The driving method according to claim 9, wherein a turned-on time of the second drive transistor is associated with a magnitude of the second data voltage and a magnitude of the first data voltages of different levels.

11. The driving method according to claim 10, wherein the third transistor is a P-type transistor; for one of the first data voltages of different voltage levels, in response to a voltage sum of the first data voltage of a voltage level output and a threshold voltage of third transistor being less than the second data voltage, the third transistor is turned off; in response to the voltage sum of the first data voltage of the voltage level and the threshold voltage of the third transistor being greater than the second data voltage, the third transistor is turned on.

12. A display panel, comprising a plurality of pixel cells arranged in an array; wherein each pixel cell is arranged with a pixel drive circuit comprising:

a power supply line, comprising a high-potential power supply and a low-potential power supply;

a light-emitting element; connected between the high-potential power supply and the low-potential power supply;

a pulse amplitude modulation unit, comprising: a first drive transistor connected to an anode of the light-emitting element and the high-potential power supply, and a pulse amplitude modulation circuit connected to a control end of the first drive transistor; wherein the first drive transistor is configured to provide driving currents with different amplitudes to the light-emitting element according to a voltage applied at the control end by the pulse amplitude modulation circuit; and a pulse width modulation unit, comprising:

a second drive transistor, connected to the anode of the light-emitting element and the pulse amplitude modulation unit;

a first transistor and a second transistor, connected to a control end of the second drive transistor;

a pulse width modulation circuit, connected to a control end of the first transistor and a control end of the second transistor; wherein a first end of the first transistor is connected to the high-potential power supply, a second end of the first transistor is connected to a first end of the second transistor, and the control end of the first transistor is connected to the pulse width modulation circuit; a second end of the second transistor is connected to the low-potential power supply, and the control end of the second transistor is connected to the pulse width modulation circuit;

a third transistor; wherein a first end of the third transistor is connected to a first data line to receive first data voltages of different voltage levels output from the first data line, and a second end of the third transistor is connected to a first node;

a fourth transistor; wherein a first end of the fourth transistor is connected to a second data line to receive a second data voltage output from the second data line, a second end of the fourth transistor is connected to a control end of the third transistor, and a control end of the fourth transistor is connected to a first scan control line; and a first capacitor; wherein a first pole plate of the first capacitor is connected to the low-potential power supply, and a second pole plate of the first capacitor is connected to the control end of the third transistor;

wherein the second drive transistor is of a same type as the first transistor, one of the first transistor and the second transistor being a P-type transistor, and the other of the first transistor and the second transistor being an N-type transistor; the pulse width modulation circuit is configured to output the first data voltages of different voltage levels with the first data line during a luminescence phase, for generating corresponding drive signals to control the first transistor or second transistor to be turned on, and controlling the second drive transistor to be turned on to control a duration of the driving currents of the light-emitting element.

13. The display panel according to claim 12, wherein the pulse width modulation unit further comprises a reset transistor; a first end of the reset transistor is connected to the first node, a second end of the reset transistor is connected to the low-potential power supply, and a control end of the reset transistor is connected to a reset control line; wherein the first node is a point where the pulse width modulation circuit is connected to the control end of the first transistor and the control end of the second transistor.

14. The display panel according to claim 12, wherein the third transistor is a P-type transistor; for one of the first data voltages of different voltage levels, in response to a voltage sum of the first data voltage of a voltage level output and a threshold voltage of third transistor being less than the second data voltage, the third transistor is turned off; in response to the voltage sum of the first data voltage of the voltage level and the threshold voltage of the third transistor being greater than the second data voltage, the third transistor is turned on;

wherein a turned-on time of the second drive transistor is associated with a magnitude of the second data voltage and a magnitude of the first data voltages of different levels.

15. The display panel according to claim 12, wherein the pulse width modulation circuit further comprises a second capacitor; a first pole plate of the second capacitor is connected to the high-potential power supply, and a second pole plate of the second capacitor is connected to the first node.

16. The display panel according to claim 12, wherein the pulse amplitude modulation circuit comprises a fifth transistor and a third capacitor;

a first end of the fifth transistor is connected to a third data line, a second end of the fifth transistor is connected to the control end of the first drive transistor, and a control end of the fifth transistor is connected to a second scan control line;

a first pole plate of the third capacitor is connected to the high-potential power supply, and a second pole plate of the third capacitor is connected to the control end of the first drive transistor.

17. The display panel according to claim 12, wherein the pulse amplitude modulation circuit comprises a fifth transistor; a first end of the fifth transistor is connected to a third data line, a second end of the fifth transistor is connected to the control end of the first drive transistor, and a control end of the fifth transistor is connected to a second scan control line;

wherein the first data line, the second data line, and the third data line are multiplexed.

18. The display panel according to claim 12, wherein the different voltage levels of the first data voltages are stepped up or stepped down.

19. The display panel according to claim 12, wherein the duration of the different voltage levels of the first data voltages is the same.

* * * * *